US011543778B2

(12) United States Patent
Zaugg et al.

(10) Patent No.: US 11,543,778 B2
(45) Date of Patent: Jan. 3, 2023

(54) ADJUSTMENT MECHANISM FOR TIMEPIECE DISPLAY MECHANISM WITH ROLLERS

(71) Applicant: Montres Breguet S.A., L'Abbaye (CH)

(72) Inventors: Alain Zaugg, Le Sentier (CH); Christophe Riedo, Le Lieu (CH)

(73) Assignee: Montres Breguet S.A., L'Abbaye (CH)

( * ) Notice: Subject to any disclaimer, the term of this patent is extended or adjusted under 35 U.S.C. 154(b) by 911 days.

(21) Appl. No.: 16/405,173

(22) Filed: May 7, 2019

(65) Prior Publication Data

US 2019/0384226 A1 Dec. 19, 2019

(30) Foreign Application Priority Data

Jun. 18, 2018 (EP) ..... 18178318

(51) Int. Cl.
*G04B 19/257* (2006.01)
*G04B 27/00* (2006.01)

(52) U.S. Cl.
CPC ..... *G04B 19/257* (2013.01); *G04B 27/002* (2013.01)

(58) Field of Classification Search
CPC ..... G04B 19/257–2578; G04B 27/002
See application file for complete search history.

(56) References Cited

U.S. PATENT DOCUMENTS 210,704 A * 12/1878 Mott ..... G04B 19/2576 368/39
222,377 A * 12/1879 Bundy ..... G04B 19/2576 968/191
250,682 A * 12/1881 Seem ..... G04B 19/2576 40/112

(Continued)

FOREIGN PATENT DOCUMENTS

CN 101326469 A 12/2008
CN 102169322 A 8/2011

(Continued)

OTHER PUBLICATIONS

Japanese Office Action dated Jul. 21, 2020 in Japanese Application 2019-100955 (with English Translation), 3 pages.

(Continued)

*Primary Examiner* — Daniel P Wicklund
(74) *Attorney, Agent, or Firm* — Oblon, McClelland, Maier & Neustadt, L.L.P.

(57) ABSTRACT

An adjustment mechanism for a timepiece display including an input wheel driving a control wheel controlling the position of a first display member, and including a differential mechanism which includes a drive wheel set retained by a jumper and pivotable via the first input wheel, to drive a planetary wheel meshing with the control wheel and pivoting off-centre with respect to a planetary wheel holder friction-mounted on a frame, the differential mechanism multiplying by a particular factor the rotation between one of the inputs and the output of the differential mechanism (Continued)

when the other input is stationary, and the planetary wheel holder includes manipulating device allowing a watch technician to release the friction to change the angular position of the planetary wheel and thus of the control wheel for correct indexing thereof with respect to another display member.

20 Claims, 3 Drawing Sheets

(56) References Cited

U.S. PATENT DOCUMENTS

| | | | | |
|---|---|---|---|---|
| 2,056,532 | A * | 10/1936 | Neyhart | G04B 19/2576 40/112 |
| 2,343,969 | A * | 3/1944 | Forbes | G04B 19/205 968/165 |
| 2,561,790 | A * | 7/1951 | Elms | G04B 19/2576 40/112 |
| 3,234,814 | A * | 2/1966 | Buckeridge | G04C 23/08 475/158 |
| 3,906,715 | A * | 9/1975 | Goto | G04B 23/00 235/115 |
| 2010/0315908 | A1 | 12/2010 | Tran et al. | |
| 2014/0321247 | A1 | 10/2014 | Cattaneo et al. | |
| 2016/0187854 | A1* | 6/2016 | Goeller | G04B 19/2576 368/39 |
| 2018/0011444 | A1* | 1/2018 | Zaugg | G04B 19/24386 |
| 2019/0384226 | A1* | 12/2019 | Zaugg | G04B 19/207 |

FOREIGN PATENT DOCUMENTS

| | | | |
|---|---|---|---|
| CN | 103324079 | A | 9/2013 |
| CN | 106164786 | A | 11/2016 |
| CN | 106483818 | A | 3/2017 |
| CN | 206671773 | U | 11/2017 |
| EP | 2 264 551 | A1 | 12/2010 |
| EP | 3 267 266 | A1 | 1/2018 |
| JP | 51-91755 | | 8/1976 |
| WO | WO 2013/030268 | A1 | 3/2013 |

OTHER PUBLICATIONS

Combined Chinese Office Action and Search Report dated Sep. 28, 2020 in Chinese Application 201910521286.0 (with English Translation of Category of Cited Documents), 7 pages.

European Search Report dated Dec. 20, 2018 in European Application 18178318.4 , filed on Jun. 18, 2018 (with English translation of categories of Cited Documents).

* cited by examiner

ADJUSTMENT MECHANISM FOR TIMEPIECE DISPLAY MECHANISM WITH ROLLERS

CROSS-REFERENCE TO RELATED APPLICATION

This application claims priority to European Patent Application No. 18178318.4 filed on Jun. 18, 2018, the entire disclosure of which is hereby incorporated herein by reference.

FIELD OF THE INVENTION

The invention concerns an adjustment mechanism for a timepiece display mechanism comprising at least a first input wheel arranged to drive, directly or indirectly, a first control wheel for controlling the position of a first display member comprised in said display mechanism.

The invention also concerns a display mechanism comprising at least one such adjustment mechanism.

The invention also concerns a watch including at least one such display mechanism.

The invention concerns the field of timepiece display mechanisms and, more particularly, display mechanisms for complications, such as calendar, moon phase, time zone or similar complications.

BACKGROUND OF THE INVENTION

CH Patent No. 310559 in the name of Fabrique d'Horlogerie de Fontainemelon discloses an independent drive device for two date displays, one for the tens and the other for the units, for displaying the 31 days of the month.

Patent Application Nos. CH00849/16, EP16177872 and EP17175547 in the name of MONTRES BREGUET SA disclose particular arrangements of such a roller display mechanism and they are not described in detail here. In particular, the date is displayed on two rollers, a simple roller for the tens and a roller with five pivoting flaps, each with two faces, for the units, which offers a high level of legibility of all the numerals displayed.

SUMMARY OF THE INVENTION

The invention proposes to facilitate the adjustment of complex display mechanisms and to simplify the initial assembly process in the factory.

To this end, the invention concerns an adjustment mechanism for a timepiece display mechanism according to claim 1.

The invention also concerns a display mechanism comprising at least one such adjustment mechanism.

The invention also concerns a watch including at least one such display mechanism.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

Figure 1:
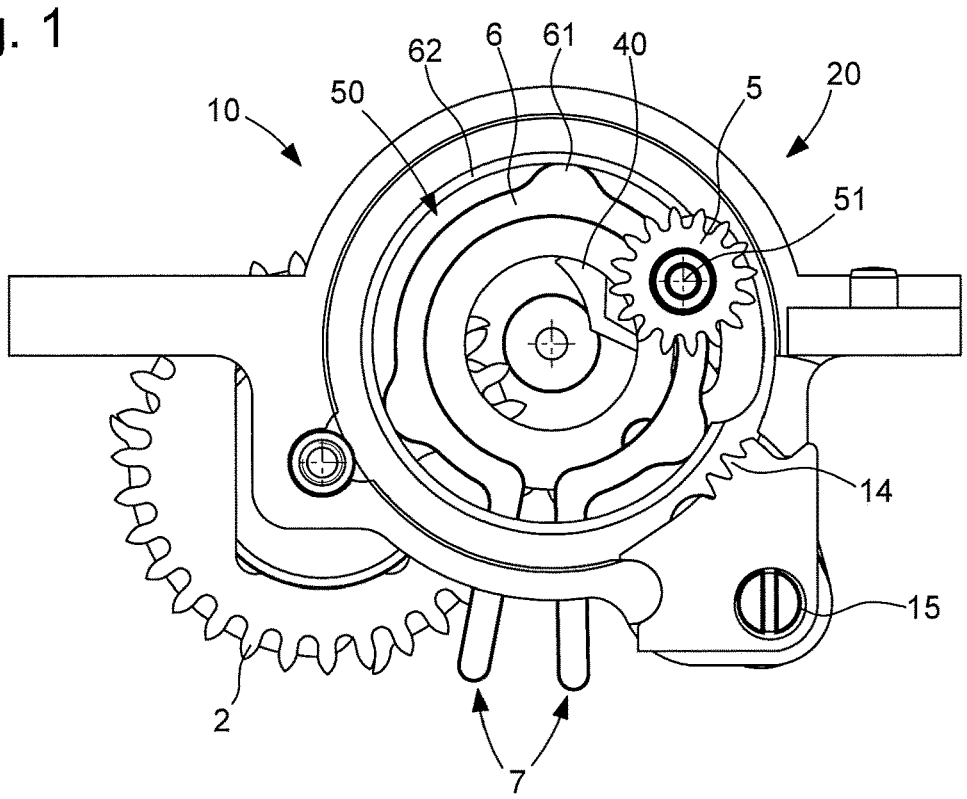
FIG. 1 represents a schematic view, from a first side, of a timepiece display mechanism with rollers comprising an adjustment mechanism according to the invention.

The invention concerns an adjustment mechanism 10 for a timepiece display mechanism 20. This display mechanism 20 includes at least a first input wheel 2, which is arranged to drive, directly or indirectly, a first control wheel 3 for controlling the position of a first display member 30 comprised in display mechanism 20.

According to the invention, adjustment mechanism 10 includes a differential gear train mechanism 50, which includes a drive wheel set 4 retained by a display jumper 40. This drive wheel set 4 is arranged to be pivoted by first input wheel 2 and is arranged to drive at least one planetary wheel 5 that meshes with first control wheel 3.

This planetary wheel 5 is pivotally mounted and is off-centre with respect to a planetary wheel holder 6. This planetary wheel holder 6 forms a friction spring, and is friction-mounted, either by protrusions 61 comprised therein, inside a cavity 62 of a frame 15 of adjustment mechanism 10, or by internal friction on a shoulder of said frame 15. Differential gear train mechanism 50 is arranged to multiply by a particular given factor, notably an integer factor, the rotation between one of the inputs and the output of the differential mechanism when the other input is stationary. This factor is equal to two for the non-limiting embodiment illustrated by the Figures, for application to the units roller of a roller display; this ratio can be 1.0 or 0.5 if, for example, it is applied to the tens roller of the same display.

Planetary wheel holder 6 includes manipulating means 7, which are arranged to allow a watch technician to release the friction to change the angular position of planetary wheel 5, which position affects and determines the position of first control wheel 3 for the correct indexing thereof with respect to at least one other display member 80 of display mechanism 20. In the non-limiting embodiment illustrated by the Figures, these manipulating means 7 include two arms that can be manipulated by tweezers or otherwise; in another embodiment, they can comprise holes or lugs, arranged to cooperate with a tool of complementary shape, such as a circlip pliers or similar. Manipulating means 7 can also be used to change the angular position of planetary wheel 5 without affecting friction, since the effect on friction is not necessary for the function but provides comfort of use.

The invention also concerns a display mechanism 20 comprising at least one such adjustment mechanism 10. More particularly, display mechanism 20 is an instantaneous or semi-instantaneous display mechanism, and includes at least one drive wheel set 9 comprising at least one finger 90 arranged to drive, directly or indirectly, first input wheel 2. The illustrated embodiment concerns a date display mechanism. Such a display mechanism, or a moon phase or time zone or other display, conventionally includes at least one large wheel with a large number of teeth of small dimensions: 31, 59, 24 teeth, and the interface with a control finger or with a jumper is generally imperfect. Thus, in particular, first input wheel 2 is a large wheel comprising at least 24 teeth.

To improve the safety of the drive function, during ordinary driving of such a wheel by a finger, particularly in a tangential drive, and to prevent the finger also driving the preceding tooth or not driving a tooth at all, and to ensure that such a large wheel is held securely in a locked position by a jumper, and thus to avoid loss of position in case of shock or acceleration during wear, it is advantageous for the large wheel concerned to be driven and held indirectly by an intermediate wheel.

To this end, in particular, display mechanism 20 includes, between each drive wheel set 9 and first input wheel 2, at least one intermediate wheel 91 comprising a number of teeth less than or equal to half the number of teeth of first input wheel 2. Each finger 90 is arranged to cooperate with intermediate wheel 91 or with a star 92 that pivots integrally with intermediate wheel 91. Display mechanism 20 includes at least one input jumper 93, for a locked position in mesh only with intermediate wheel 91 or with such a star 92, and a correction jumper 94 which is also in mesh only with intermediate wheel 91 or with such a star 92, for the change of position.

More particularly, at least one intermediate wheel 91 pivots integrally with a star 92.

More particularly, display mechanism 20 includes a first drive wheel set 9, which is a drive wheel set and a second drive wheel set 9 which is a correction wheel set.

More particularly, on each jump in position of intermediate wheel 91, this at least one intermediate wheel 91 is arranged to shift by only one tooth first input wheel 2, or a second input wheel 22, or a front wheel 21, pivoting synchronously with first input wheel 2.

More particularly, at least one intermediate wheel 91 has a pivot axis orthogonal to that of first input wheel 2 or of a second input wheel 22 pivoting synchronously with first input wheel 2.

More particularly, display mechanism 20 includes a second input wheel 22, or a front wheel 21, pivoting synchronously with first input wheel 2, and said second input wheel 22 or said front wheel 21 as in the case of the Figures, cooperates with at least one intermediate wheel 91.

More particularly, display mechanism 20 includes a single intermediate wheel 91 arranged to cooperate with each drive wheel set 9.

The non-limiting example illustrated by the Figures concerns a first input wheel 2 with 31 teeth, including one raised tooth, pivoting synchronously with a second input wheel 22 pivoting synchronously with first input wheel 2, and which is a truncated wheel with 31 teeth of which only 4 teeth remain in positions 10, 20, 30 and 31, and also pivoting synchronously with a front wheel 21 with 31 teeth. This front wheel 21 makes possible a change of axis of rotation, which is necessary for the roller display mechanism illustrated in the Figures, since the axes of the rollers are parallel to the plane of the main plate and perpendicular to the axes of the wheel sets of the movement. Intermediate wheel 91 has 12 teeth and cooperates with a twenty-four hour finger 90, mounted in a conventional manner resiliently on drive wheel set 9. Here, intermediate wheel 91 is coaxial and synchronous with a twelve-tooth date star 92. The date finger, driven by a timepiece movement (not represented) works once per day, at midnight, with date star 92 to make a step of $\frac{1}{12}$th of a revolution. Intermediate wheel 91 drives 31-tooth front wheel 21 to make a jump of $\frac{1}{31}$st of a revolution, in a gear ratio of 12:31. As date star 92 has only 12 teeth here, the drive function has greatly increased safety features compared to a conventional direct drive mechanism on a wheel with 31 teeth, and the locking function using a jumper is similarly improved. There may be only one intermediate wheel 91 with star 92 if NIHS (Swiss watch industry standard) teeth are used, with pointed teeth allowing both driving by a finger and positioning by a jumper.

In a particular application of the invention, illustrated by the Figures, display mechanism 20 is a display mechanism with rollers, wherein the first display member 30 is a first roller, and at least one other display member 80 is a second roller, particularly but not exclusively coaxial to the first roller.

Patent Application Nos. CH00849/16, EP16177872 and EP17175547 by the same Applicant disclose particular arrangements of such a roller display mechanism and they are not described in detail here. In particular, the date is displayed on two rollers, a simple roller for the tens and a roller with five pivoting flaps, each with two faces, for the units, which offers a high level of legibility of all the numerals displayed. The units are displayed over two turns of the roller, in comparison to the display of the units disc of CH310559 which makes only one turn. The solution consisting in driving a 5-tooth star is not optimal geometrically, especially as regards crossing the at least one missing tooth which produces the change from 31 to 01. An advantageous solution cited in Patent Application Nos. CH00849/16, EP16177872, et EP17175547 is to multiply by an integer factor, here a factor of two, the rotation of a star with a larger number of teeth, here a star with ten teeth forming drive wheel set 4, by means of a multiplier wheel set inserted between this 10-tooth star and the roller.

The multiplier gear train, notably a multiplier-by-two, requires indexing so that the units numerals are displayed facing the tens numerals. Since the train is a multiplier gear train, extreme precision is required for this indexing function. The assembly process must also be simplified, since any design with precise angular indexing of the trains causes difficulty for the watch technician responsible for the assembly operation, or adjustment in after-sales service.

More particularly, when it is coaxial, the second roller is arranged to be driven, directly or indirectly by first input wheel 2 or by a second input wheel 22 pivoting synchronously with first input wheel 2.

More particularly, the second coaxial roller is arranged to be driven, directly or indirectly, by a second input wheel 22 pivoting synchronously with first input wheel 2 and having an incomplete toothing.

More particularly, the first roller includes at least one flap 12 with two faces, with two display symbols on either side, pivoting integrally with a pinion 13 which is arranged to pivot when it meshes with a toothed sector 14 comprised in a frame 15 of display mechanism 20.

More particularly, display mechanism 20 is a date display mechanism and the first roller is a units display roller driven indirectly by a first input wheel 2 which is a 31-tooth wheel with one tooth removed (30 teeth remaining), or with two successive teeth removed (29 teeth remaining). The second roller is then a tens roller, driven directly by a second input wheel 22 pivoting synchronously with first input wheel 2 and which is a truncated 31-tooth wheel with only 4 teeth remaining in positions 10, 20, 30 and 31.

Figure 6:
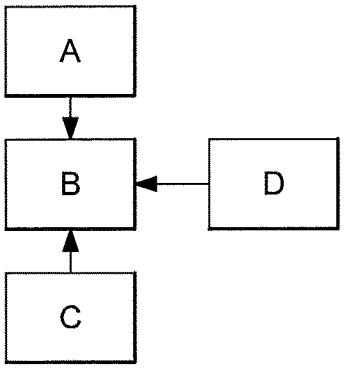
FIG. 6 is a block diagram illustrating the functions of the differential mechanism.
Figure 7:
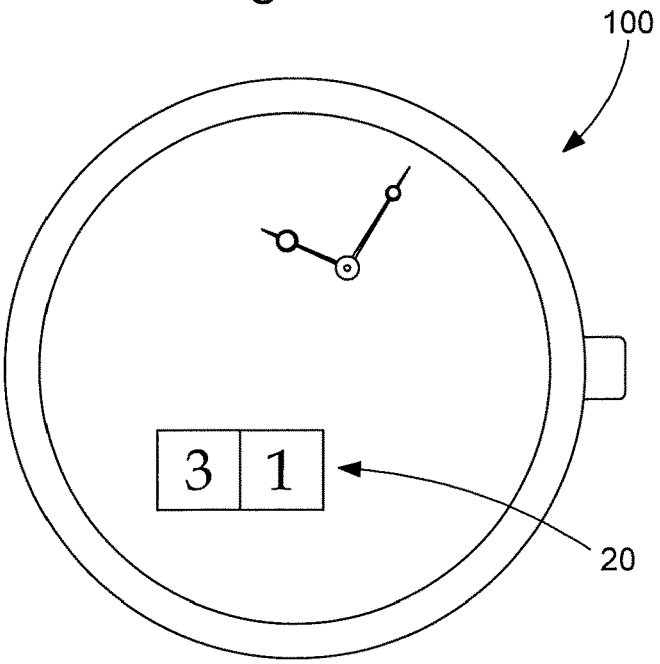
FIG. 7 represents a schematic front view of a watch comprising the roller display mechanism of FIG. 1.

Differential gear train mechanism 50 is represented schematically in FIG. 6:

A: indexing and multiplication (by a factor of two here);

B: driving of the units, ten-tooth star, 1/10th revolution per day;

C: units display;

D: indexing of the units, on the friction spring.

This differential gear train directly makes possible multiplication by two between the first input and the output, when the second input is stationary.

A rotation on the second input rotates the units roller independently of the ten-tooth star and aligns the units display on the tens display.

This rotation is ensured by friction or by a locking function, so that rotation can only occur at the moment of adjustment by the watch technician, in the particular embodiment wherein gripping means 7 of friction-mounted planetary wheel holder 6 are inside the watch case.

The differential gear train can advantageously be placed concentrically to the units roller, but this embodiment is not limiting.

Figure 2:
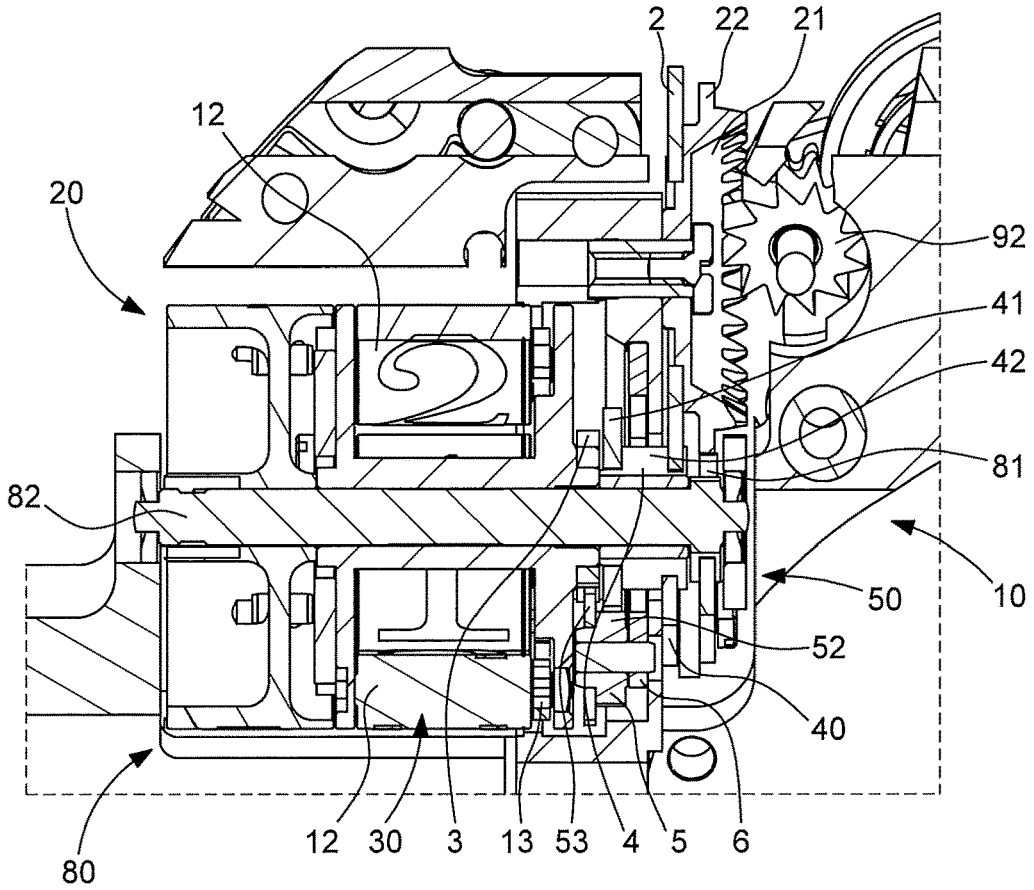
FIG. 2 represents a schematic view of the mechanism of FIG. 1, in cross-section through the axis of a planetary wheel of a differential mechanism comprised in the adjustment mechanism.
Figure 3:
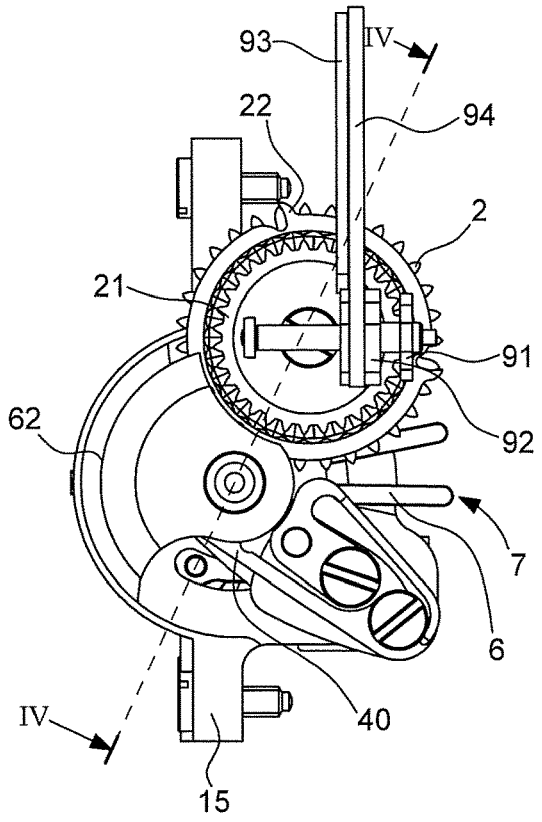
FIG. 3 represents a schematic view of the mechanism of FIG. 1, from a second side, opposite to the first side.
Figure 4:
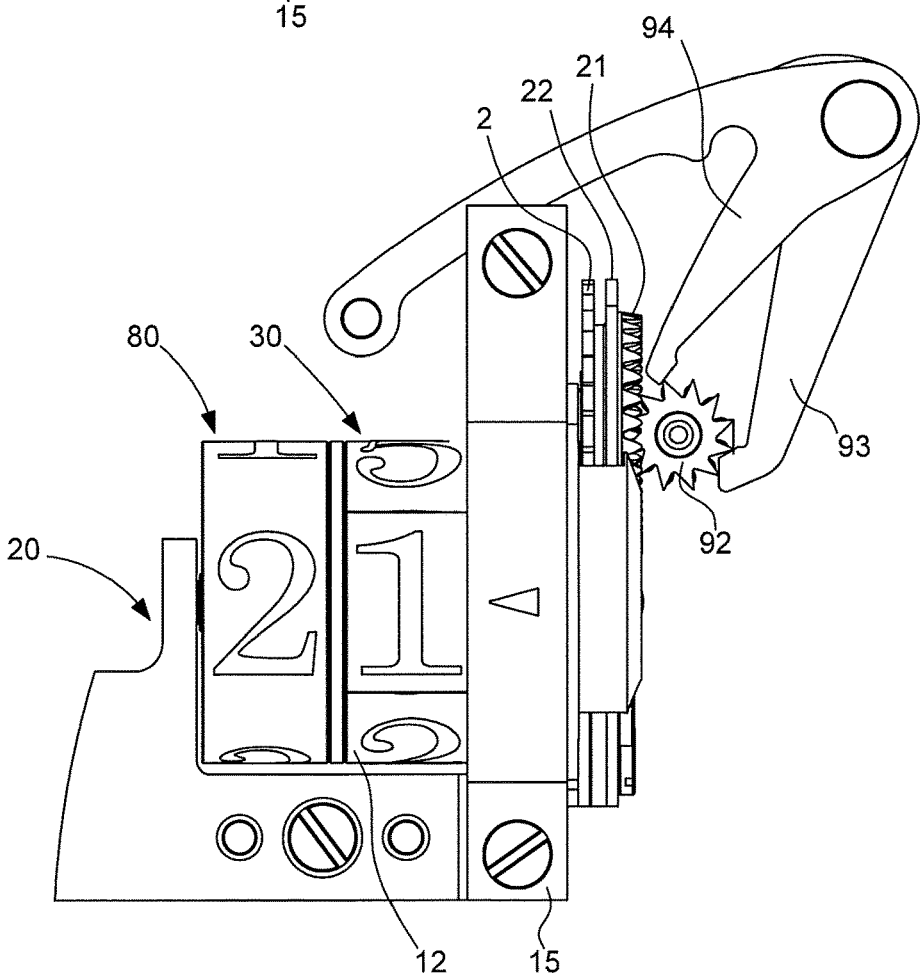
FIG. 4 represents a schematic elevation of the roller display mechanism of FIG. 1.
Figure 5:
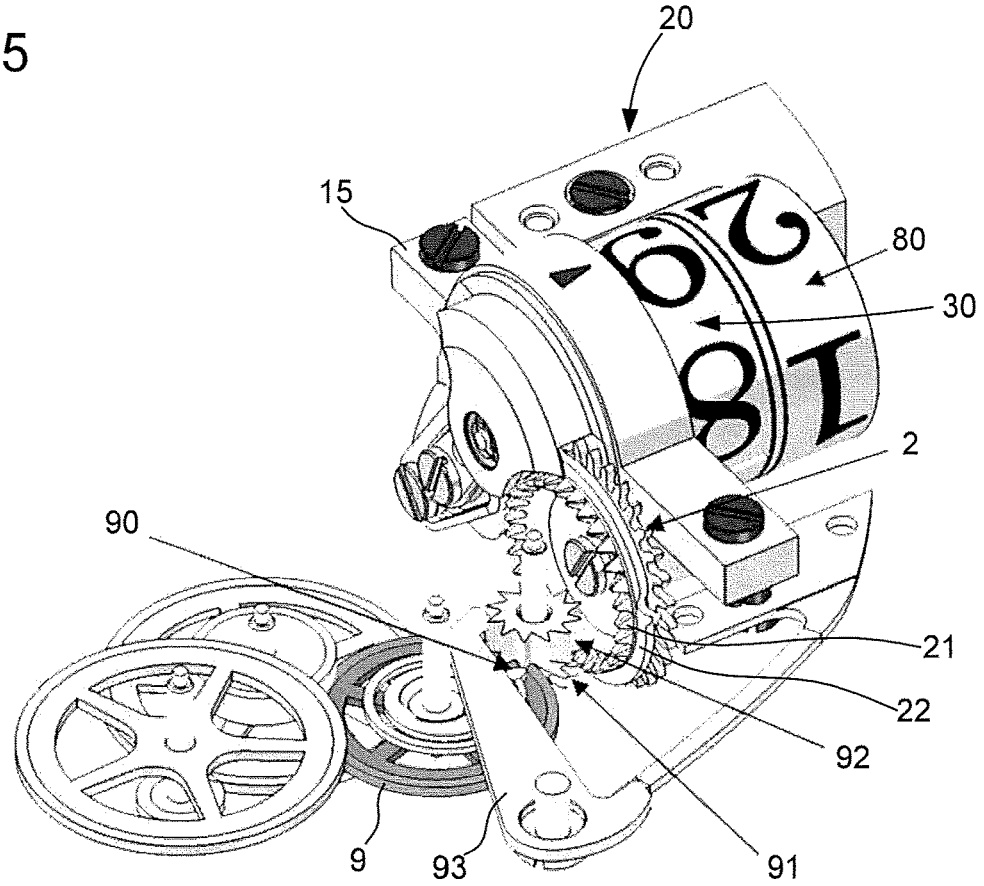
FIG. 5 represents a schematic, perspective view of a part of the roller display mechanism of FIG. 1 wherein an input wheel is driven by an intermediate wheel.

FIG. 2 shows the kinematic chain. Star 92 integral with intermediate wheel 91 drives front wheel 21 and thus first input wheel 2, which is arranged to drive drive wheel set 4, via a ten-tooth star 42. This drive wheel set 4 includes a plate 41, which has twenty-five teeth here, integral with ten-tooth star 42, and which meshes with pinion 52, which has ten teeth here, of a planetary wheel 5 of arbor 51, this planetary wheel 5 pivoting with respect to planetary wheel holder 6. Planetary wheel 5 includes a plate 53, which has 16 teeth here, which meshes with first control wheel 3, which is the pinion here of first roller 30 and has twenty teeth. Second input wheel 22 is arranged to mesh with a pinion 81 of arbor 82 of second roller 80.

When the arbor of planetary wheel 5 is immobilised in position by friction (normal operation at the date jump), the rotation NR of first roller 30, as a function of the rotation NE of drive wheel set 4 (ten-tooth star) is, in this particular and non-limiting example, equal to: NR=NE*25/10*16/20=2*0.1=0.2.

More particularly, the first roller has five pivoting flaps 12 bearing on their ten faces the numerals from zero to nine. Thus, the rotation of 1/5th of a revolution per day is duly performed.

When drive wheel set 4 (ten-tooth star) is immobilised by its jumper 40, i.e. in normal operation between midnight and 23:30 hours, one of the elements of the differential calculation changes to zero, and rotation NR is calculated as a function of the manipulation of the friction spring by the watch technician NF (=38°).

$$NR=NF*20*10/(20*10-16*25)=-38°.$$

The rotation of 38° (+/−19°) is duly performed and is correct and sufficient for indexing whatever the assembly: one tooth of first control wheel 3 corresponding to 360°/20=18°.

The friction spring is released by manipulating gripping means 7, which are radial elements in the Figures.

More particularly, display mechanism 20 also includes a roller for indicating the days of the week and including one or three pivoting flaps 12.

More particularly, display mechanism 20 includes a roller for indicating the months and including six pivoting flaps 12.

More particularly, display mechanism 20 includes a roller for indicating the leap years.

More particularly, display mechanism 20 includes a roller for indicating the moon phases, arranged to be driven by a wheel with 59 teeth.

More particularly, display mechanism 20 includes a roller for indicating the day/night, arranged to pivot twice per day.

In short, the invention, as illustrated, makes it possible to rotate a roller with respect to the ten-tooth star, which allows perfect alignment of the numerals or symbols featured on the various rollers, in relation to one another.

In an application to a conventional flat display, the friction spring according to the invention greatly facilitates adjustments in calendar watches, for example for an annual date display.

The invention is described here in a particular application wherein gripping means 7 are accessible only to the watch technician, thus preferably inside the watch case, but it is evident that these gripping means can also be placed on the exterior of the watch case for operation by the user, provided that they are accompanied by indispensable sealing means. An application to a static timepiece, such as a clock, does not require very elaborate sealing means, and is easy to achieve with an adjustment mechanism using a differential gear and friction spring according to the invention.

This friction assembly of planetary wheel holder 6 is advantageous, since it obviates the usual prior adjustments, and, in the particular illustrated case of a roller display, it avoids having to index the roller pinion 3 on roller 30, the wheel of the reduction wheel set on its pinion, and the wheel of the ten-tooth star on the star. These three wheel sets can thus be assembled without any particular indexing, which represents a significant saving in terms of time and expertise. The invention avoids having to index the wheel set during assembly of the rollers, the components are roughly assembled, and adjustment is performed after assembly.

The invention is particularly suited to a perpetual calendar mechanism. The invention also concerns a watch 100 including at least one such display mechanism 20.

The invention claimed is:

1. An adjustment mechanism for a timepiece display mechanism comprising at least a first input wheel arranged to drive, directly or indirectly, a first control wheel for controlling the position of a first display member comprised in said display mechanism, the adjustment mechanism comprising:

a differential gear train mechanism which includes a drive wheel set retained by a display jumper and is arranged to be pivoted by said first input wheel, and arranged to drive at least one planetary wheel meshing with said first control wheel and mounted pivotally and off-centre with respect to a planetary wheel holder friction-mounted, either inside a cavity of a frame of said adjustment mechanism, or by internal friction on a shoulder of said frame, said differential gear train mechanism being arranged to multiply by a particular factor the rotation between one of the inputs and the output of said differential mechanism when the other input is stationary, and wherein said planetary wheel holder includes manipulating means arranged to allow a watch technician to release said planetary wheel and change the angular position of said planetary wheel, which determines the position of said first control wheel for the correct indexing thereof with respect to at least one other display member of said display mechanism.

2. A display mechanism including at least one said adjustment mechanism according to claim 1, wherein said display mechanism is an instantaneous or semi-instantaneous display mechanism, in that said first input wheel is a large wheel including at least 24 teeth, wherein said display mechanism includes at least one drive wheel set including at least one finger arranged to drive, directly or indirectly, said first input wheel, and wherein said display mechanism includes, between each said drive wheel set and said first input wheel, at least one intermediate wheel including a number of teeth less than or equal to half the number of teeth of said first input wheel, in that each said finger is arranged to cooperate with said intermediate wheel or with a star pivoting integrally with said intermediate wheel, and wherein said display mechanism includes at least one input jumper, for a locked position in mesh only with said intermediate wheel or with a said star, and a correction jumper also in mesh only with said intermediate wheel or with a said star, for the change of said position.

3. The display mechanism according to claim 2, wherein at least one said intermediate wheel pivots integrally with a said star.

4. The display mechanism according to claim 2, wherein said display mechanism includes one said drive wheel set which is a drive wheel set and one said drive wheel set which is a correction wheel set.

5. The display mechanism according to claim 2, wherein, on each jump in position of said at least one intermediate wheel, said intermediate wheel is arranged to shift by only one tooth said first input wheel or a second input wheel pivoting synchronously with said first input wheel.

6. The display mechanism according to claim 5, wherein said display mechanism includes a said second input wheel or a front wheel pivoting synchronously with said first input wheel, and said second input wheel or front wheel cooperates with at least one said intermediate wheel.

7. The display mechanism according to claim 2, wherein at least one said intermediate wheel has a pivot axis orthogonal to that of said first input wheel or of a second input wheel pivoting synchronously with said first input wheel.

8. The display mechanism according to claim 2, wherein said display mechanism includes only one said intermediate wheel arranged to cooperate with each said drive wheel set.

9. A watch comprising at least one display mechanism according to claim 2.

10. A display mechanism including the adjustment mechanism according to claim 1, wherein said display mechanism is a roller display mechanism, wherein said first display member is a first roller, and wherein at least one said other display member is a second roller coaxial to said first roller.

11. The display mechanism according to claim 10, wherein said second coaxial roller is arranged to be driven, directly or indirectly by said first input wheel or by a second input wheel pivoting synchronously with said first input wheel.

12. The display mechanism according to claim 11, wherein said second coaxial roller is arranged to be driven, directly or indirectly, by a second input wheel pivoting synchronously with said first input wheel and having an incomplete toothing.

13. The display mechanism according to claim 10, wherein said roller includes at least one flap having two faces, with two display symbols on either side, pivoting integrally with a pinion arranged to pivot when meshing with a toothed sector comprised in a frame of said display mechanism.

14. The display mechanism according to claim 13, wherein said display mechanism is a date display mechanism, in that said first roller is a units display roller driven indirectly by a said first input wheel which is a 31-tooth wheel from which one tooth is removed or from which two consecutive teeth are removed, and wherein said second roller is a tens roller directly driven by a second input wheel pivoting synchronously with said first input wheel and which is a truncated 31-tooth wheel with only 4 teeth remaining in positions 10, 20, 30 and 31 teeth, and wherein said first roller includes five said pivoting flaps bearing on the ten faces thereof the numerals from zero to nine.

15. The display mechanism according to claim 13, wherein said display mechanism is a date display mechanism, in that said first roller is a units display roller driven indirectly by a said first input wheel, which is a 31-tooth wheel from which one tooth is removed, or from which two consecutive teeth are removed, and wherein said second roller is a tens roller driven directly by a second input wheel pivoting synchronously with said first input wheel and which is a truncated 31-tooth wheel having only 4 teeth remaining in positions 10, 20, 30, and 31 and wherein said display mechanism includes a roller for indicating the days of the week and including one or three pivoting flaps.

16. The display mechanism according to claim 13, wherein said display mechanism is a date display mechanism, in that said first roller is a units display roller driven indirectly by a said first input wheel which is a 31-tooth wheel from which one tooth is removed, or from which two consecutive teeth are removed, and wherein said second roller is a tens roller, driven directly by a second input wheel pivoting synchronously with said first input wheel and which is a truncated 31-tooth wheel having only 4 teeth remaining in positions 10, 20, 30 and 31, and wherein said display mechanism includes a roller for indicating the months and including six pivoting flaps.

17. The display mechanism according to claim 10, wherein said display mechanism is a date display mechanism, in that said first roller is a units display roller driven indirectly by a said first input wheel, which is a 31-tooth wheel from which one tooth is removed, or from which two consecutive teeth are removed, and wherein said second roller is a tens roller, driven directly by a second input wheel pivoting synchronously with said first input wheel and which is a truncated 31-tooth wheel with only 4 teeth remaining in positions 10, 20, 30 and 31.

18. The display mechanism according to claim 10, wherein said display mechanism includes a roller for indicating the leap years.

19. The display mechanism according to claim 10, wherein said display mechanism includes a roller for indicating the moon phases, arranged to be driven by a wheel with 59 teeth.

20. The display mechanism according to claim 10, wherein said display mechanism includes a roller for indicating the day/night, arranged to pivot twice per day.

* * * * *